US010236593B2

(12) United States Patent
Dufilie et al.

(10) Patent No.: US 10,236,593 B2
(45) Date of Patent: Mar. 19, 2019

(54) STACKED PATCH ANTENNA ARRAY WITH CASTELLATED SUBSTRATE

(71) Applicant: Massachusetts Institute of Technology, Cambridge, MA (US)

(72) Inventors: Pierre A. Dufilie, Boston, MA (US); Jeffrey S. Herd, Rowley, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 211 days.

(21) Appl. No.: 15/277,346

(22) Filed: Sep. 27, 2016

(65) Prior Publication Data

US 2018/0090852 A1 Mar. 29, 2018

(51) Int. Cl.

| | |
|---|---|
| ***H01Q 21/06*** | (2006.01) |
| ***H01Q 9/04*** | (2006.01) |
| ***H01Q 1/38*** | (2006.01) |
| ***H01Q 1/28*** | (2006.01) |
| ***H01Q 1/48*** | (2006.01) |
| ***H01Q 21/00*** | (2006.01) |

(52) U.S. Cl.

CPC ..... *H01Q 21/065* (2013.01); *H01Q 1/288* (2013.01); *H01Q 1/38* (2013.01); *H01Q 1/48* (2013.01); *H01Q 9/0414* (2013.01); *H01Q 21/0093* (2013.01)

(58) Field of Classification Search

CPC ..... H01Q 21/065; H01Q 1/38; H01Q 9/0414

See application file for complete search history.

(56) References Cited

U.S. PATENT DOCUMENTS

| | | | |
|---|---|---|---|
| 2005/0156802 A1 | 7/2005 | Livingston et al. | |
| 2009/0046025 A1 | 2/2009 | Gardner et al. | |
| 2011/0001682 A1 | 1/2011 | Rao | |
| 2015/0084814 A1* | 3/2015 | Rojanski | H01Q 1/42 342/368 |

OTHER PUBLICATIONS

PCT International Search Report of the ISA for PCT/US2016/053918 dated Dec. 13, 2016; 4 pages.

PCT Written Opinion of the ISA for PCT/US2016/053918 dated Dec. 13, 2016; 5 pages.

* cited by examiner

*Primary Examiner* — Graham Smith

(74) *Attorney, Agent, or Firm* — Daly, Crowley, Mofford & Durkee, LLP

(57) ABSTRACT

Described is a printed circuit antenna array including at least one castellated substrate. Also described is a stacked patch antenna array having at least one castellated substrate.

22 Claims, 5 Drawing Sheets

STACKED PATCH ANTENNA ARRAY WITH CASTELLATED SUBSTRATE

GOVERNMENT RIGHTS

This invention was made with government support under Contract No. FA8721-05-C-0002 awarded by the U.S. Air Force. The government has certain rights in this invention.

CROSS REFERENCE TO RELATED APPLICATION

Not applicable.

FIELD

The subject matter described herein relates generally to radio frequency (RF) antennas and more particularly to stacked-patch antenna arrays.

BACKGROUND

As is known in the art, in space-based systems and other airborne systems, there is a desire and need to reduce, and ideally minimize, the weight of circuits and systems used in such systems.

Some space-based systems (including, but not limited to space-based radar or communication systems) utilize space-based antenna arrays. To manufacture a relatively large antenna array, a plurality of antenna elements may be printed on a relatively large sheet of a dielectric material (sometimes referred to as a "panel"). Such a panel can be a significant source of weight in a space-based or airborne system. To create even larger antenna arrays, a modular approach may be used in which like or similar panels are coupled together. The panels may be disposed in support/alignment frames and arranged in groups (or "tiled") in desired patterns to form an entire antenna array. This approach adds even more weight to the antenna array.

In general, prior art approaches to reducing the weight of an array antenna in space-based and airborne systems have focused on attempting to minimize the size and weight of the frame and related structures supporting the antenna array.

SUMMARY

The present disclosure relates to microstrip antenna designs and more particularly to lightweight, low-cost patch antenna designs capable of achieving wide operational scan angles (e.g. scan-capable to 60 degrees). Such patch antenna designs find use in a wide range of applications including, but not limited to, space-based systems and airborne systems (e.g. space-based and airborne radar systems and communication systems which utilize array antennas). The concepts, systems and techniques described herein may be used in any application requiring lightweight antenna arrays. It should be appreciated that the concepts, systems and techniques described herein are scalable meaning that antennas provided in accordance with the described concepts, systems and techniques may operate at any frequency in the radio frequency (RF) range (e.g. the range of about 3 kHz to about 300 GHz) assuming required manufacturing tolerances are satisfied.

The patch antennas described herein include one or more castellated substrates. The manner in which a substrate is castellated may be selected to improve, and ideally optimize, the antenna array for weight reduction without adversely impacting antenna performance. In some instances it may be possible to enhance one or more antenna performance characteristics over a limited frequency range and/or a limited scan range.

In some embodiments, a patch antenna array may be provided from one or more castellated substrates having one or more radiating structures (e.g. patch antenna elements) disposed thereon. In some embodiments, a patch antenna array is provided from two or more castellated substrates with each having one or more radiating structures disposed thereon.

In some embodiments a stacked path antenna array includes a non-castellated substrate having one or more patch elements disposed thereon and one or more castellated substrates having one or more patch elements disposed thereon. In some embodiments, the non-castellated substrate may be disposed over the one or more castellated substrates. In some embodiments, one or more castellated substrates may be disposed over the non-castellated substrate. In some embodiments, the non-castellated substrate may be disposed between one or more castellated substrates.

In some embodiments a stacked path antenna array includes a plurality of non-castellated substrates having one or more patch elements disposed thereon and a plurality of castellated substrates having one or more patch elements disposed thereon. In some embodiments, the plurality of non-castellated substrates may be disposed over the plurality of castellated substrates. In some embodiments, the plurality of castellated substrates may be disposed over the plurality of non-castellated substrates. In some embodiments, at least some of the non-castellated substrates may be disposed between one or more castellated substrates. In some embodiments, at least some of the castellated substrates may be disposed between one or more of the non-castellated substrates. In some embodiments, the plurality of non-castellated substrates may be interleaved with the plurality of castellated substrates.

Such stacked patch antenna array structures are capable of operation over a bandwidth which is wider than a single level antenna with little or no increase in physical size.

In some embodiments, the antenna elements used in the patch antenna array are configured for operation in different frequency bands and/or different polarizations.

In some embodiments the stacked path antenna array includes a non-castellated substrate disposed over a castellated substrate with each of the substrates having one or more patch antenna elements disposed thereon. The castellated substrate is disposed over a ground plane.

In accordance with one aspect of the concepts, systems, circuits, and techniques described herein, an antenna array comprises a first castellated substrate, a first array of antenna elements disposed on at least one surface of the castellated substrate and a conductive surface disposed below the castellated substrate and spaced apart from the first array of antenna elements with the conductive surface serving as a ground plane for the first array of antenna elements disposed on the first castellated substrate.

The antenna array may include one or more of the following features independently or in combination with another feature to include: the first array of antenna elements provided as a first array of patch antenna elements; a second substrate disposed over the castellated substrate and a second array of antenna elements disposed on the second substrate; first and second array of antenna elements provided as patch antenna elements; the second substrate may be either a castellated or a non-castellated substrate; each of the at least one antenna elements is provided as a microstrip antenna element; a foam spacer is optionally disposed between the castellated substrate and said second substrate; the first castellated substrate is a first one of a plurality of castellated substrates disposed over each other and disposed over the ground plane with each of the plurality of castellated substrates having at least one antenna element disposed thereon; at least two of the plurality of castellated substrates are provided having have different castellation patterns; a non-castellated substrate is disposed over at least one of a plurality of castellated substrates and an array of antenna elements is disposed on a surface of the non-castellated substrate; the antenna array includes a plurality of non-castellated substrates with each having at least one antenna element disposed thereon and with at least one of the plurality of non-castellated substrates disposed over one of a plurality of castellated substrates; and the antenna array may include a plurality of non-castellated substrates interleaved with a of plurality of castellated substrates.

In accordance with a further aspect of the concepts, systems, circuits, and techniques described herein, an antenna array includes a first castellated substrate with one or more patch antenna elements disposed on a surface thereof and a conductive surface disposed below the castellated substrate with the one or more patch antenna elements spaced apart from the conductive surface which serves as a ground plane for the one or more patch antenna elements. The antenna array further includes a non-castellated substrate disposed over the castellated substrate with the non-castellated substrate having one or more patch antenna elements disposed thereon and spaced apart from the one or more patch antenna elements on the castellated substrate.

BRIEF DESCRIPTION OF THE DRAWINGS

The foregoing features may be more fully understood from the following description of the drawings in which.

DETAILED DESCRIPTION

In the description that follows, various features, concepts, systems and techniques are described in the context of a stacked-patch antenna array. It should be appreciated that these features, concepts, systems and techniques may also be used with other types of planar or conformal radiating structures and surfaces.

Before describing a stacked patch antenna array having a castellated substrate, some introductory concepts are explained. As described herein space-based or airborne systems refer to any space-borne or airborne systems that may have any of a variety of different purposes. A space-based radar, for example, refers to space-borne radar systems which may be used for object detection or other purposes. Similarly, space-based communication systems refers to space-borne communications systems. Certain radar and telecommunication systems may be provided as a collection of individual components such as communications networks, transmission systems, relay stations, tributary stations, and data terminal equipment (DTE) usually capable of interconnection and interoperation to form an integrated whole. Thus, a space-based or airborne radar or communication system refers to a system in which at least some components are space-borne or airborne.

Furthermore, it should also be appreciated that features, concepts, systems and techniques described herein find use in antenna arrays for any application including, but not limited to space-based, airborne, ground-based, or water-based applications.

Figure 1:
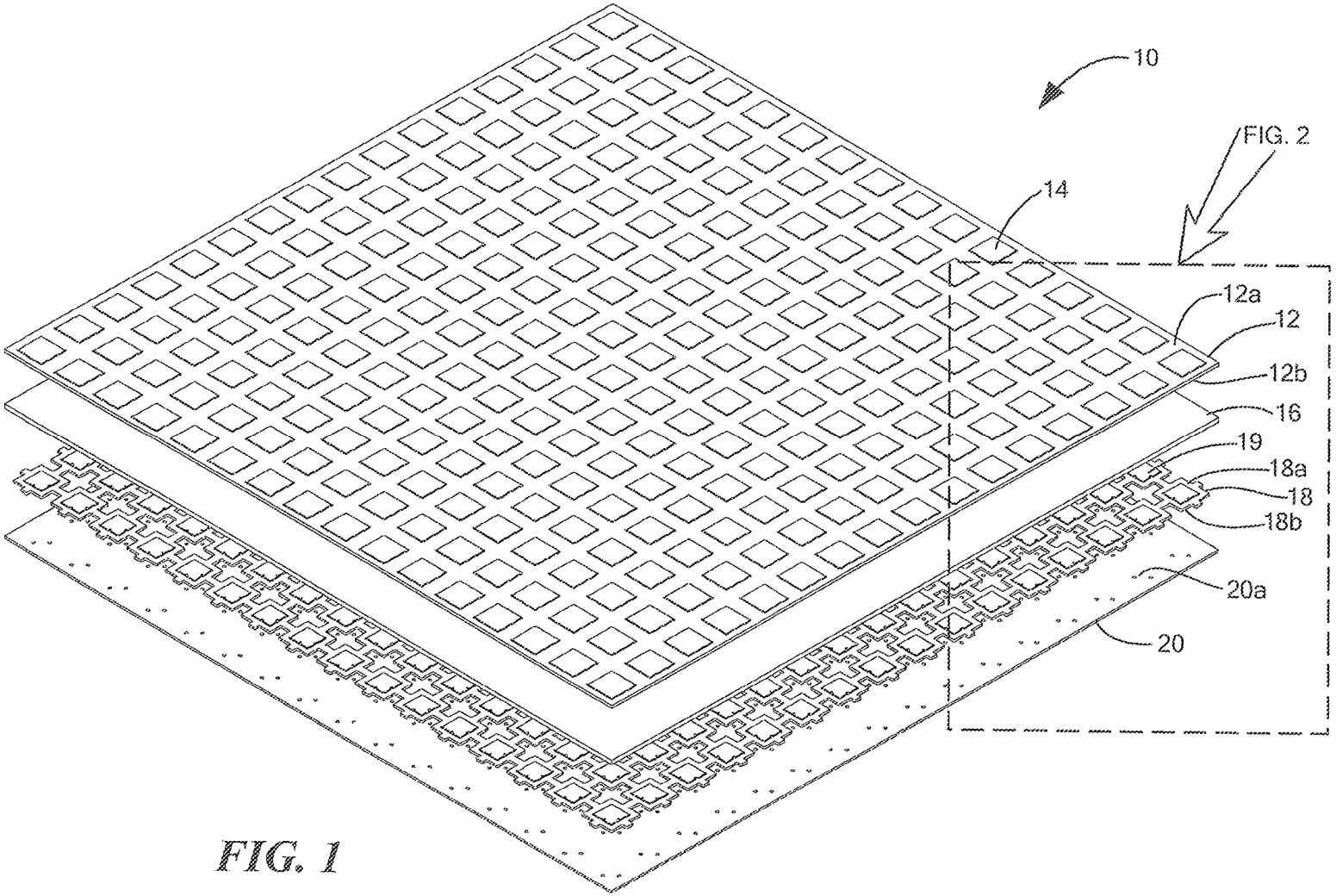
FIG. 1 is an isometric exploded view of a stacked-patch antenna array having a castellated substrate.
Figure 2:
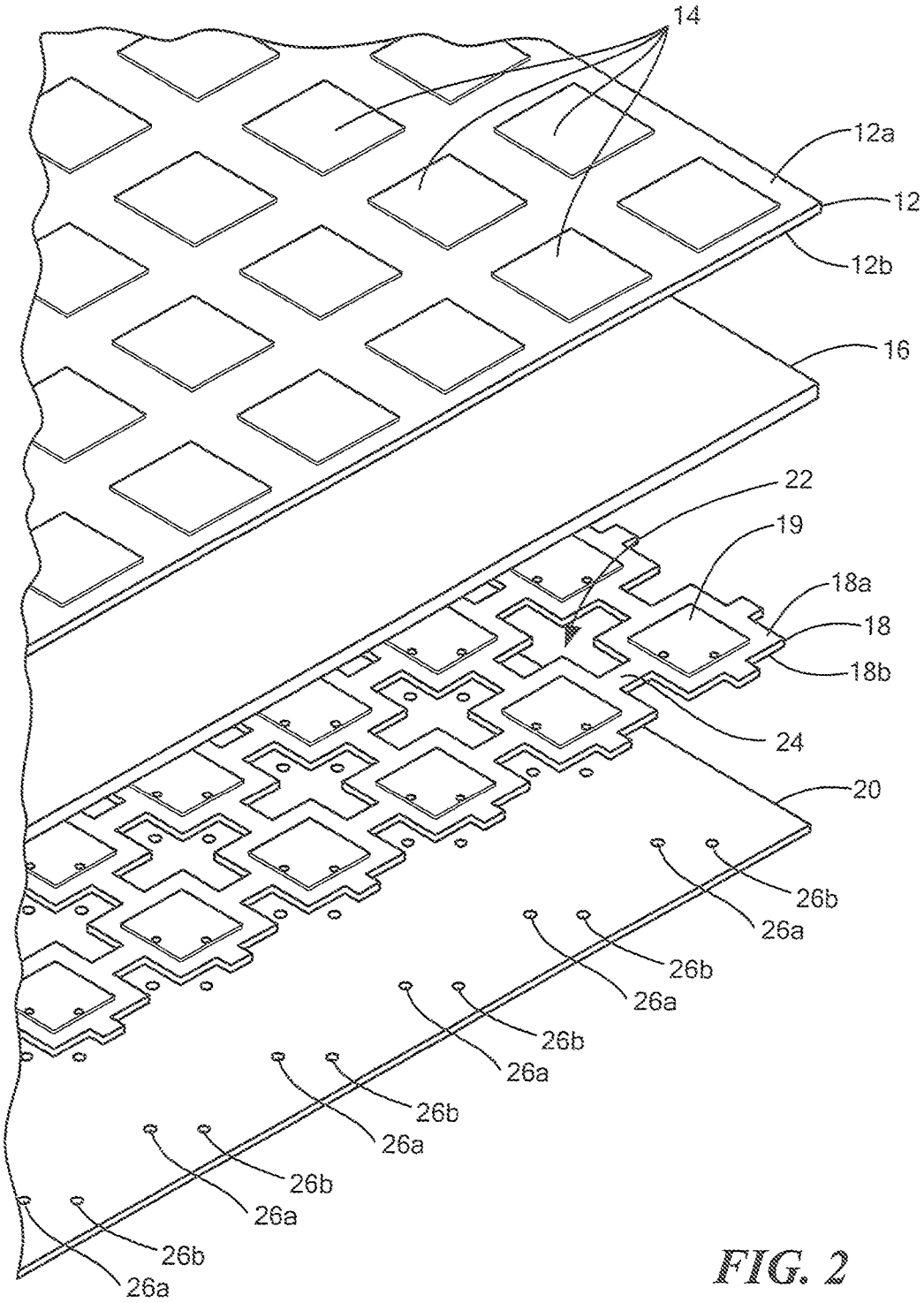
FIG. 2 is an expanded isometric exploded view of a stacked-patch antenna array having a castellated substrate.
Figure 3:
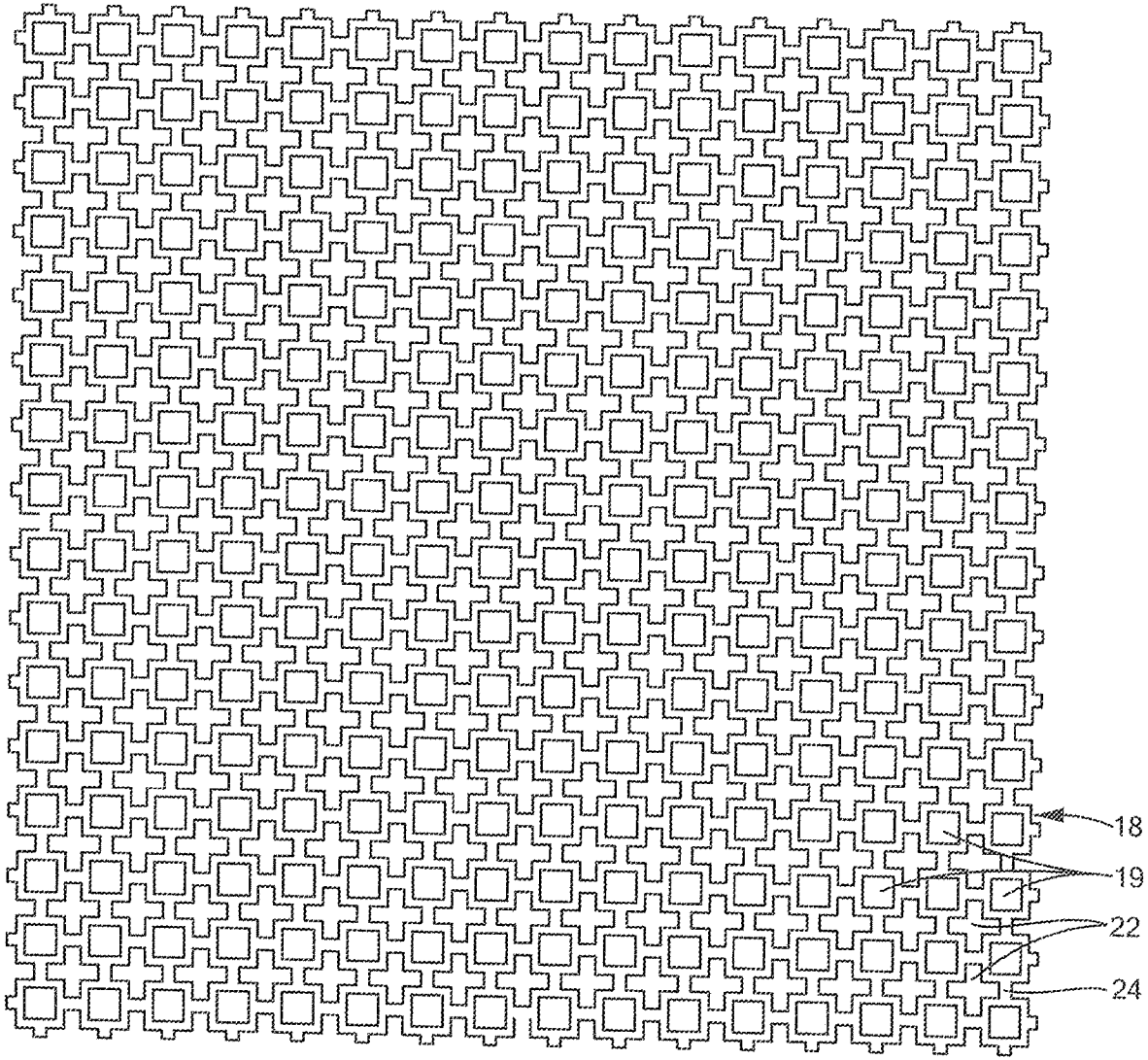
FIG. 3 is a top view of a patch antenna array disposed on a castellated substrate.

Referring now to FIGS. 1-3 in which like elements are provided having like reference designations throughout the several views, a stacked-patch antenna array 10 includes a first (or upper or top) substrate 12 having first and second opposing surfaces 12*a*, 12*b*. Disposed over one of the substrate surfaces (here the upper surface 12*a*) are a plurality (or array) of conductors corresponding to patch antenna elements 14. It should be appreciated that in some embodiments, it may be desirable or even necessary for patch antenna elements to be provided on surface 12*b*. The patch elements 14 may be disposed on a surface of substrate 12 using any technique including any additive or subtractive technique known to those of ordinary skill in the art.

A foam spacer 16 is disposed between surface 12*b* of upper substrate 12 and a surface 18*a* of a lower, castellated substrate 18. Disposed over surface 18*a* of the lower substrate 18 are a second plurality (or array) of conductors 19 which form a second plurality of patch antenna elements. Castellated substrate 18 is provided having a ground plane conductor 20 disposed over a second surface 18*b* thereof. The combination of the upper and lower substrates and associated patch elements together provide the stacked-patch antenna array. In this illustrative embodiment, the stacked-patch antenna array also includes spacer 18 and ground plane 20. It should be appreciated that in some embodiments, it may be desirable or even necessary for patch antenna elements 19 to be provided on surface 18*b* of substrate 18. In this case, surface 18*b* of substrate 18 must be spaced apart from ground plane 20 (e.g. by a foam spacer or air). Alternatively, ground plane 20 must be provided in a manner which does not prevent patch antenna elements 19 from functioning as intended.

It should be appreciated that in some embodiments, the foam spacer may be omitted. In such embodiments, the upper substrate is disposed over the lower substrate. In some embodiments, substrate surfaces 12*b*, 18*a* may be in direct contact with each other. In other embodiments, substrate surfaces 12*b*, 18*a* may be spaced apart by air (e.g. using spacers to space substrate surfaces 12*a*, 12*b*). In such embodiments, the combination of the upper and lower substrates and associated patch elements together provide the stacked-patch antenna array.

Significantly, and as may be most clearly seen in FIG. 2, the lower substrate 18 is provided having portions thereof removed. Thus, substrate 18 is said to be castellated.

The manner in which the substrate is castellated may be selected based upon a variety of factors including, but not limited to, the amount of weight reduction desired and the desired antenna performance. In the illustrative embodiment of FIGS. 1-3, the substrate is castellated using cross-shaped openings between each antenna element. The shape and pattern of the openings is selected to provide weight reduction (and sometimes a significant weight reduction) without a significant decrease (and ideally no decrease) in antenna performance. Thus, openings 22 reduce the mass of the antenna array (ideally without any significant reduction in antenna operating characteristics) and it should be appreciated that, in general, a trade-off may be made between antenna weight and antenna performance.

Although the openings in castellated substrate 18 are here shown as having a cross-shape, any regular geometric shape may be used (e.g. square, rectangular, triangular, circular or any other shape). Furthermore, some or all of the openings 22 may also be provided having an arbitrary or irregular shape. Such an arbitrary or irregular shape may be selected for openings 22, for example, so as to allow for desirable placement of connectors or other circuits or structures necessary to fabricate or assemble or for proper operation the antenna array.

Furthermore, although in this illustrative embodiment, openings 22 are all provided having the same shape and are regularly spaced (here, openings are provided between each antenna element 19), it should be appreciated that in some embodiments, it may be desirable or even necessary to provide openings 22 having different shapes (i.e. each opening 22 may not have the same shape). In some applications it may be desirable or even necessary to not provide openings 22 between each antenna element 19. And it may be desirable or even necessary to provide openings 22 in substrate 18 in a pattern which is not symmetric. The shape and pattern (i.e. a castellation pattern) of openings 22 may be selected based upon a variety of factors including, but not limited to the amount weight reduction desired, the required antenna electrical characteristics (e.g. scan volume vs. antenna input impedance, frequency bandwidth, maximum scan angle, antenna beam width, the type and geometry of the antenna element being used to provide the array, the array element lattice structure, the cross-polarization properties, the average and peak sidelobe levels, the efficiency of the antenna, and the frequency of operation).

In some embodiments, it may be possible to select a shape and pattern of openings in the castellated substrate so as to provide a tuning function. In this case, the manner in which the substrate is castellated may be selected to improve, and ideally optimize, the antenna array for weight reduction without any substrate change in antenna operating characteristics. Furthermore, depending upon a thickness of the castellated substrate, it may also be possible to select a shape and pattern of openings 22 in the castellated substrate which allows tuning and enhances one, some or all antenna characteristic over a desired frequency range and/or scan volume).

As noted above, the illustrative embodiment of FIGS. 1-3 show the castellated substrate 18 having cross-shaped holes or openings cut, or otherwise provided, therein. This cross-shape has been found to offer a maximum or near maximum reduction in weight without any significant reduction in antenna operating characteristics. The cross-shaped openings 22 result in removal of about ⅓ of the material of substrate 18 while still allowing the antenna array to have acceptable antenna performance characteristics.

The dimensions of openings 22 directly affect antenna performance as removal of portions of the lower substrate 18 may de-tune the upper patches 14. In some applications, it is important that pattern, size and shape of the openings 22 are selected so as not to significantly degrade the electrical performance of the array over scan.

In this illustrative embodiment, the lower substrate 18 includes interconnecting tabs 24 between antenna elements. The location and dimensions of tabs 24 are selected to result in acceptable antenna array performance. In this illustrative embodiment, interconnecting tabs follow the same rectangular grid pattern as antenna elements 19. In other embodiments, however, interconnecting tabs may follow a diagonal path between elements rather than a grid pattern. Other interconnecting tab patterns may also be used and may be selected in accordance with a variety of factors including, but not limited to, the type and shape of antenna element 19 and the polarization of antenna 10 (e.g. single linear polarization, dual-linear polarization or circular polarization).

The existence of interconnecting tabs 24 allows the lower substrate 18 to be fabricated in a "panelized" fashion—i.e. antenna elements 19 may be provided on a large substrate (or panel) using additive or subtractive techniques. The opening may be cut (e.g. using laser cutting techniques) or otherwise provided in the substrate to result in castellated substrate 18.

As may be most clearly seen in FIGS. 2 and 3, the tabs 24 couple those portions of substrate 18 over which conductors 19 are disposed. As may also be seen in FIG. 2, ground plane 20 is provided having openings (or "reliefs") 26*a*, 26*b* provided therein to accept probe-type feeds (e.g. pin feeds). Thus, each antenna element 19 is fed from a pair of pins disposed through respective ones of opening 26*a*, 26*b* such that each antenna element 19 maybe fed with two orthogonal polarizations (e.g. vertical and horizontal polarizations).

Those of ordinary skill will appreciate that other types of feed structures may also be used including, but not limited to, capacitive feed structures. Those of ordinary skill in the art will understand how to select a feed circuit which is appropriate to suit the needs of a particular application.

It should be appreciated that although the castellated substrate is here shown used with a square patch antenna element, those of ordinary skill in the art will appreciate that other patch element shapes (e.g. circular patches to provide the antenna array having circular polarization) may also be used. It should also be appreciated that other types of microstrip or printed circuit antenna array elements such as printed dipoles or spirals may also be used.

In at least one implementation, an optimized lightweight stacked patch antenna array having a castellated substrate similar to antenna array 10 described in conjunction with FIGS. 1-3 was designed that is operative within a frequency band extending from 8 GHz to 10 GHz and while a achieving wide operational scan angles (e.g. scan-capable to 60 degrees). This corresponds to a percentage bandwidth of about 22% for a stacked patch antenna array. In this example, the operational band of the antenna is defined as the frequency band within which the reflection coefficient of the antenna is below −6 dB (i.e., the band edges are the frequencies at which the reflection coefficient transitions above −6 dB).

In some embodiments, holes may be provided in substrates 12, 18 and foam 16 to allow for out-gassing during a fabrication process (e.g. holes may be drilled into the corners of substrates 12, 18 and foam 16 to allow for out-gassing). Such out-gassing holes are provided having a size and shape selected to not impact antenna array performance.

Figure 4:
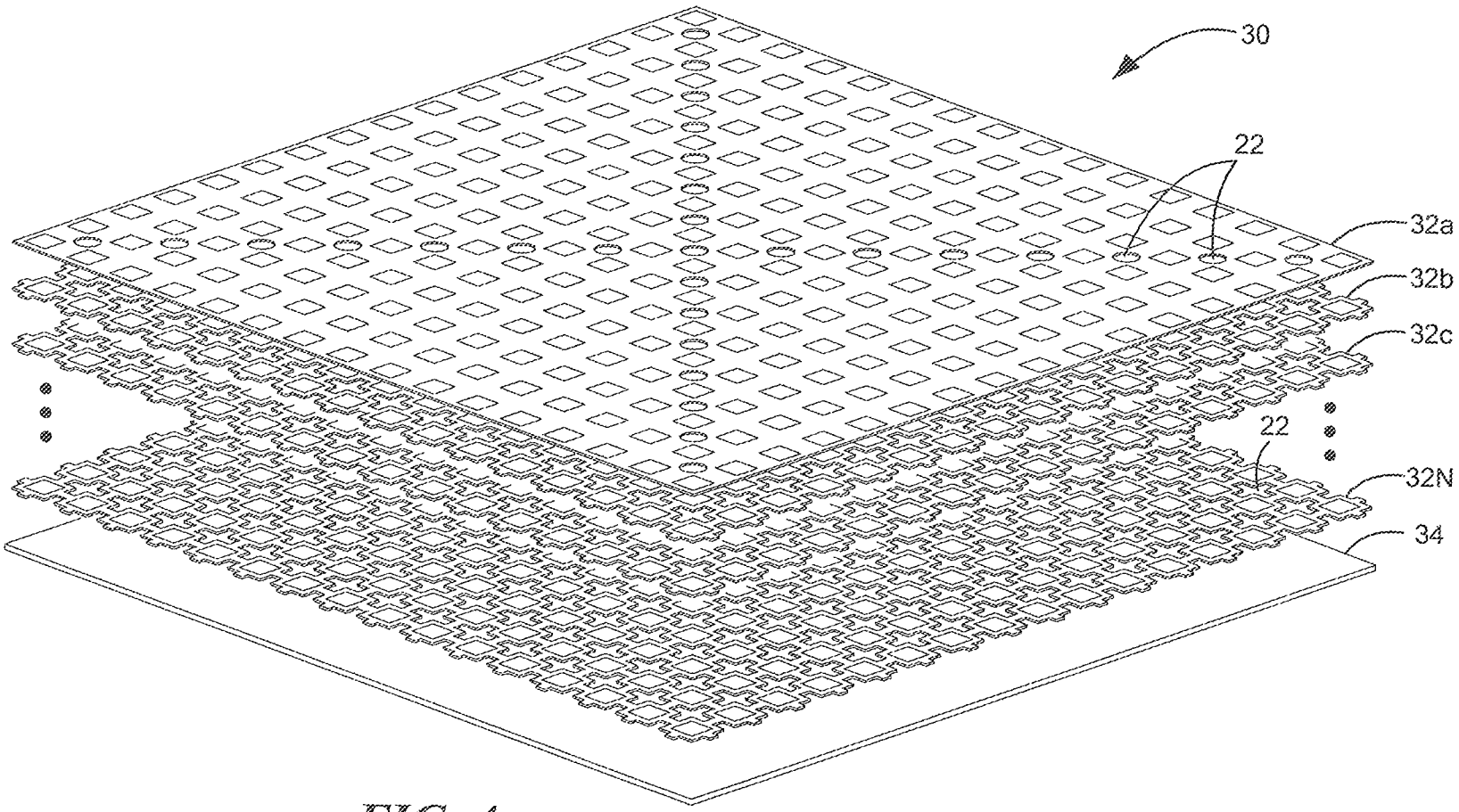
FIG. 4 is an isometric exploded view of a stacked-patch antenna array having a plurality of castellated substrates.

Referring now to FIG. 4, in at least one embodiment, an antenna 30 includes a plurality of castellated substrates. As shown, the antenna 30 includes antenna elements on an upper substrate 32*a* as well as several intermediate substrates 32*b*-32N between the upper substrate and a ground plane 34. The ground plane may serve as a ground plane for radiators on both the upper level and the intermediate substrates 32*a*-32N.

As described above, in some implementations, the radiator(s) and openings 22 on the substrates 32*a*-32N are selected having different shapes and castellation patterns. For example substrate 32*a* is provided having generally circular openings in an X-castellation pattern while substrates 32*a*-32N are provided having a cross-shape and are provided between each antenna element in a grid castellation pattern.

In some embodiments, however, multi-stack, antenna arrays may include at least one non-castellated substrate. For example, in the antenna of FIG. 4 instead of having all castellated substrates it would be possible to include a single non-castellated substrate.

In the embodiments described above, the radiators on the different substrates may all be the same type of radiator. In other embodiments, however, it may be desirable of necessary to use different types of radiators on the various substrates.

The manner in which each substrate 32*a*-32N is castellated may be selected to improve, and ideally optimize, the antenna array for weight reduction without adversely impacting antenna performance. In some instances it may be possible to enhance one or more antenna performance characteristics over a limited frequency range and/or a limited scan range (e.g. by selecting a castellation pattern or shape of openings which tunes antenna performance).

In some embodiments, a patch antenna array may be provided from one or more castellated substrates having one or more radiating structures (e.g. patch antenna elements) disposed thereon. In some embodiments, a patch antenna array is provided from two or more castellated substrates with each having one or more radiating structures disposed thereon.

In some embodiments a stacked path antenna array includes a non-castellated substrate having one or more patch elements disposed thereon and one or more castellated substrates having one or more patch elements disposed thereon. In some embodiments, the non-castellated substrate may be disposed over the one or more castellated substrates. In some embodiments, one or more castellated substrates may be disposed over the non-castellated substrate. In some embodiments, the non-castellated substrate may be disposed between one or more castellated substrates.

Figure 5:
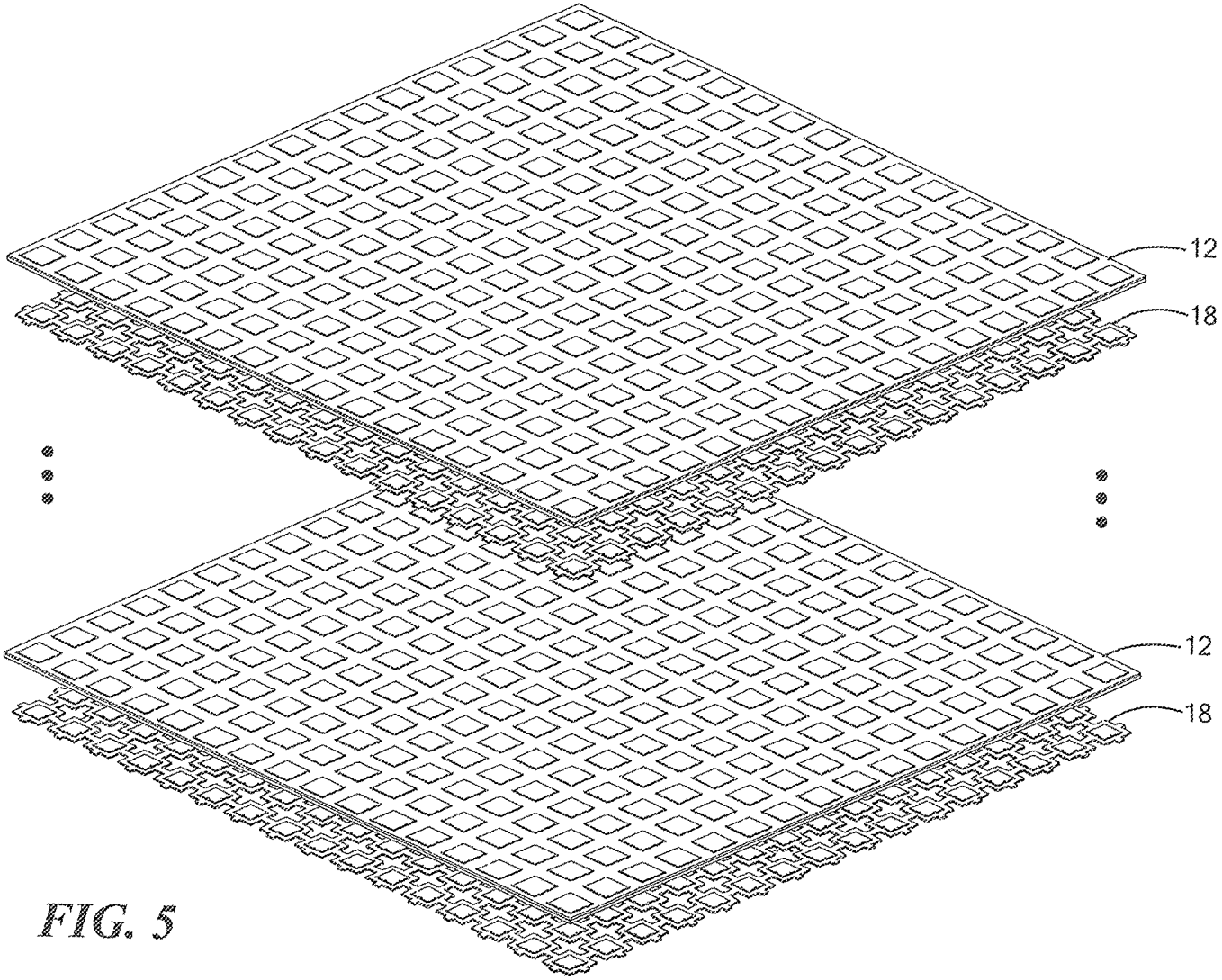
FIG. 5 is an isometric exploded view of a stacked-patch antenna array having interleaved castellated and non-castellated substrates.

In some embodiments a stacked path antenna array includes a plurality of non-castellated substrates having one or more patch elements disposed thereon and a plurality of castellated substrates having one or more patch elements disposed thereon. In some embodiments, the plurality of non-castellated substrates may be disposed over the plurality of castellated substrates. In some embodiments, the plurality of castellated substrates may be disposed over the plurality of non-castellated substrate. In some embodiments, at least some of the non-castellated substrate may be disposed between one or more castellated substrates. In some embodiments, at least some of the castellated substrates may be disposed between one or more of the non-castellated substrates. In some embodiments, the non-castellated substrates may be interleaved with the plurality of castellated substrates (see FIG. 5).

Such stacked patch antenna array structures are capable of operation over a bandwidth which is wider than a single level antenna with little or no increase in physical size.

In some embodiments, the antenna elements used in the patch antenna array may be configured for operation in different frequency bands and/or different polarizations.

In some embodiments the stacked path antenna array includes a non-castellated substrate disposed over a castellated substrate with each of the substrates having one or more patch antenna elements disposed thereon. The castellated substrate is disposed over a ground plane.

As used herein, the terms "optimal," optimized," and the like do not necessarily refer to the best possible configuration of an antenna to achieve a desired goal over all possible configurations, but can refer to the best configuration that was found during an optimization procedure given certain limits of the procedure.

Having described exemplary embodiments of the invention, it will now become apparent to one of ordinary skill in the art that other embodiments incorporating their concepts may also be used. The embodiments contained herein should not be limited to disclosed embodiments but rather should be limited only by the spirit and scope of the appended claims. All publications and references cited herein are expressly incorporated herein by reference in their entirety.

What is claimed is:

1. An antenna array comprising:

a first substrate having first and second opposing surfaces and a plurality of air-filled openings extending between the first and second opposing surfaces so as to provide the substrate as a first castellated substrate having first and second opposing surfaces;

a first array of antenna elements disposed on one of the surfaces of said castellated substrate; and a conductive surface disposed below said castellated substrate and spaced apart from said first array of antenna elements, said conductive surface serving as a ground plane for said first array of antenna elements disposed on the one surface of said first castellated substrate.

2. The antenna array of claim 1 wherein said first array of antenna elements is provided as a first one of a plurality of arrays of patch antenna elements disposed on the one surface of said castellated substrate.

3. The antenna array of claim 1, further comprising:

a second substrate disposed over said castellated substrate, said second substrate having first and second opposing surfaces; and a second array of antenna elements disposed on a first one of the first and second surfaces of said second substrate.

4. The antenna array of claim 3 wherein said first and second array of antenna elements are each provided as an array of patch antenna elements.

5. The antenna array of claim 3 wherein said second substrate is a non-castellated substrate.

6. The antenna array of claim 3 wherein said second substrate is a castellated substrate.

7. The antenna array of claim 3, wherein each of said at least one antenna elements is provided as a microstrip antenna element.

8. The antenna array of claim 3 further comprising a foam spacer disposed between said castellated substrate and said second substrate.

9. The antenna array of claim 8 wherein said second substrate is a non-castellated substrate.

10. The antenna array of claim 1 wherein said first castellated substrate is a first one of a plurality of castellated substrates disposed over each other and disposed over said ground plane, each of said plurality of castellated substrates, having first and second opposing surfaces and at least one antenna element disposed on a first one of the first and second surfaces of said castellated substrates.

11. The antenna array of claim 10, wherein at least two of said plurality of castellated substrates have different castellation patterns.

12. The antenna array of claim 11, further comprising:

a non-castellated substrate disposed over at least one of said plurality of castellated substrates, said non-castellated substrate having first and second opposing surfaces; and an array of antenna elements disposed on a first one of the first and second surfaces of said non-castellated substrate.

13. The antenna array of claim 12, wherein said non-castellated substrate is a first one of a plurality of non-castellated substrates, each of said non-castellated substrates having at least one antenna element disposed thereon, with at least some of said at least some of said plurality of non-castellated substrates disposed over one of said plurality of castellated substrates.

14. The antenna array of claim 13, wherein said plurality of non-castellated substrates are interleaved with said plurality of castellated substrates.

15. The antenna array of claim 1 further comprising two or more castellated substrates each having one or more antenna element disposed thereon.

16. The antenna array of claim 1 further comprising:

a non-castellated substrate having one or more patch elements disposed thereon, said non-castellated substrate disposed over said first castellated substrate.

17. An antenna array comprising:

a first substrate having first and second opposing surfaces and a plurality of air-filled openings extending between the first and second opposing surfaces so as to provide the substrate as a first castellated substrate having a first surface and a second opposing surface;

one or more patch antenna elements disposed on the first surface of said castellated substrate;

a conductive surface disposed on the second surface of said castellated substrate, said conductive surface serving as a ground plane for the one or more patch antenna elements;

a non-castellated substrate disposed over the first surface of said castellated substrate, said non-castellated substrate having one or more patch antenna elements disposed thereon.

18. An antenna array comprising:

a first substrate having first and second opposing surfaces and a plurality of air-filled openings extending between the first and second opposing surfaces so as to provide the substrate as a first castellated substrate having a first surface and a second opposing surface;

one or more patch antenna elements disposed on the first surface of said castellated substrate; and a conductive surface disposed below the second surface of said castellated substrate, said one or more patch antenna elements on said castellated substrate spaced apart from said conductive surface, said conductive surface serving as a ground plane for the one or more patch antenna elements disposed on the first surface of said castellated substrate.

19. The antenna array of claim 18 further comprising a non-castellated substrate disposed between the second surface of said castellated substrate and said conductive surface, with said non-castellated substrate having one or more patch antenna elements disposed thereon and spaced apart from said conductive surface.

20. An antenna array comprising:

a first castellated substrate having first and second opposing surfaces;

a first array of antenna elements disposed on one of the surfaces of said castellated substrate; and a conductive surface disposed below said castellated substrate and spaced apart from said first array of antenna elements, said conductive surface serving as a ground plane for said first array of antenna elements disposed on one of the surfaces of said first castellated substrate, wherein:

said first castellated substrate is a first one of a plurality of castellated substrates disposed over each other and disposed over said ground plane, each of said plurality of castellated substrates, having first and second opposing surfaces and at least one antenna element disposed on one of the surfaces of said castellated substrates;

at least two of said plurality of castellated substrates have different castellation patterns; and wherein the antenna array further comprises:

a non-castellated substrate disposed over at least one of said plurality of castellated substrates, said non-castellated substrate having first and second opposing surfaces; and an array of antenna elements disposed on one of the surfaces of said non-castellated substrate.

21. The antenna array of claim 20, wherein said non-castellated substrate is a first one of a plurality of non-castellated substrates, each of said non-castellated substrates having at least one antenna element disposed thereon, with at least some of said at least some of said plurality of non-castellated substrates disposed over one of said plurality of castellated substrates.

22. The antenna array of claim 21, wherein said plurality of non-castellated substrates are interleaved with said plurality of castellated substrates.

* * * * *